United States Patent [19]

Hara

[11] Patent Number: 4,957,101

[45] Date of Patent: Sep. 18, 1990

[54] PORTABLE BUBBLE BATH ASSEMBLY

[75] Inventor: Zenzaburo Hara, Tokyo, Japan

[73] Assignee: Hara Health Industrial Co., Ltd., Tokyo, Japan

[21] Appl. No.: 88,422

[22] Filed: Aug. 21, 1987

[51] Int. Cl.[5] ..... A61H 9/00

[52] U.S. Cl. ..... 128/66; 4/542

[58] Field of Search ..... 128/66; 4/542, 541, 4/543, 544, 581, 369; 261/36.1, 121

[56] References Cited

U.S. PATENT DOCUMENTS

| | | | |
|---|---|---|---|
| 2,730,095 | 1/1956 | Scott | 128/66 |
| 3,286,712 | 11/1966 | Roden | 4/544 |
| 3,366,110 | 1/1968 | Gaylord, Jr. | 4/541 |
| 3,585,991 | 6/1971 | Balamuth | 128/66 |
| 3,587,976 | 6/1971 | Jacuzzi | 178/66 |
| 3,641,996 | 2/1972 | Friend | 128/66 |
| 3,674,020 | 7/1972 | Jacuzzi | 128/66 |
| 3,806,464 | 4/1974 | Vaneyos et al. | 4/542 |
| 3,842,823 | 10/1974 | Jacuzzi et al. | 128/66 |
| 3,961,382 | 6/1976 | Peterson | 128/66 |
| 4,100,917 | 7/1978 | Talge et al. | 128/66 |
| 4,127,117 | 11/1978 | Peterson | 128/66 |
| 4,599,753 | 7/1986 | Goodman | 4/542 |
| 4,665,572 | 5/1987 | Davidson | 4/542 |
| 4,726,917 | 2/1988 | Abe | 128/66 |
| 4,774,934 | 10/1988 | Hara | 128/66 |
| 4,796,046 | 11/1988 | Newberry | 128/66 |

FOREIGN PATENT DOCUMENTS

| | | | |
|---|---|---|---|
| 0210821 | 2/1987 | European Pat. Off. | 4/541 |
| 2428591 | 1/1976 | Fed. Rep. of Germany | 128/66 |

*Primary Examiner*—Edgar S. Burr
*Assistant Examiner*—Huong Q. Pham
*Attorney, Agent, or Firm*—Kane, Dalsimer, Sullivan, Kurucz, Levy, Eisele and Richard

[57] ABSTRACT

A portable bubble bath assembly disclosed is designed to be installed in the bathtub and includes an underwater electric pump, a nozzle and a retaining member for retaining the nozzle over the bath water upon the installment of the assembly. The pump has an inlet and an outlet. The nozzle is connected to the outlet of the pump. The retaining member includes: a setting member for stably setting the pump on the bottom wall of the bathtub; and a support member, interposed between the pump and the nozzle, for supporting the nozzle over the pump. The only step due upon the installment of this bubble bath assembly is the placing of the pump on the bottom wall of the bathtub with the nozzle positioned above the pump.

4 Claims, 4 Drawing Sheets

PORTABLE BUBBLE BATH ASSEMBLY

BACKGROUND OF THE INVENTION

This invention relates to a bubble bath assembly which generates a multiplicity of minute bubbles in the water in a bathtub, in particular, to the bubble bath assembly of a portable type.

In the related art, U.S. patent application Ser. No. 855,628 filed Apr. 2, 1986 discloses a health bath structure having a nozzle which is retained above the water in a bathtub. This health bath structure has a pump-encasing housing which is fixedly mounted on the wall of a bathroom, and therefore installment work is necessary upon the installation of this structure. Moreover, since this structure is fixed at a specific position, an auxiliary equipment is required in order to transfer the nozzle to a desired position.

U.S. Pat. No. 3,842,823 discloses a portable hydromassage unit designed to straddle the side wall of a bathtub. This unit has a clamping bracket which is movable along the bridge portion of the housing, which is adapted to rest on the top of the side wall of the bathtub. By adjusting the position of the clamping bracket, the clamping bracket is capable of clamping the side wall in cooperation with a power unit housing, which is adapted to be disposed outside the bathtub, and whereby the hydromassage unit is removably installed on the side wall of the bathtub. However, when the side wall of the bathtub has a thickness exceeding the range of adjusting movement of the bracket, it is not possible to mount the hydromassage unit on the bathtub. In particular to a bath of dugout type, hydromassage unit of the above-mentioned type can not be applied.

SUMMARY OF THE INVENTION

Accordingly, it is an object of the present invention to provide a portable bubble bath assembly which is not only applicable to any type of bathtub but also able to be easily installed on any type of bathtub.

Another object of the present invention is to provide a bubble bath assembly, the nozzle of which can easily be transferred to the desired position.

With these and other objects in view, the present invention provides a bubble bath assembly including: an underwater electric pump having an inlet and an outlet; a nozzle member connected to the outlet of the pump; and means for retaining the nozzle member over the water in a bathtub upon the installment of the assembly in the bathtub. The retaining means comprises: means for stably setting the pump on the bottom wall of the bathtub; and support means, interposed between the pump and the nozzle member, for supporting the nozzle member over the pump. The only step due upon the installment of this bubble bath assembly is the placing of the pump on the bottom wall of the bathtub with the nozzle member positioned above the pump. Therefore, this assembly is applicable to any type of bathtub without any difficulty such as troublesome installment work. Also, since this assembly is transferrable within the bathtub, the nozzle can easily be moved to a desired position at the convenience of users.

Upon the operation of the pump, water is drawn into the pump from the bathtub through the inlet of the pump, and is discharged in a jet from the nozzle member against the surface of the bath water. This jet of water introduces oxygen into the bath water, resulting in the formation of a layer of minute bubbles covering the surface of the bath water. When these innumerable bubbles break, they generate ultrasonic waves which help in the prevention of skin diseases and muscular pains which can afflict on the human body.

The setting means may be a bottom housing enclosing the pump. The bottom housing has a lower end and is adapted to be disposed in the bathtub with its lower end placed on the upper face of the bottom wall of the bathtub. The support means may be a connecting pipe having opposite ends. The connecting pipe is attached at one of its ends to the nozzle member and at the other end to the pump so that the nozzle member is in fluid communication with the outlet of the pump.

The setting means may include a suction cup member attached to the lower end of the bottom housing. The suction cup member secures the bottom housing to the bottom wall of the bathtub when the suction cup member is applied to the upper surface of the bottom wall of the bathtub.

The bottom housing may have a suction opening in fluid communication with the inlet of the pump. The bottom housing may also have a lower end surface which faces to the bottom wall of the bathtub when the bottom housing is placed in the bathtub. It is preferred that the suction opening is formed in the lower end surface of the bottom housing so that the assembly is urged by suction toward the bottom wall of the bathtub when the bath water is drawn into the pump through the suction opening.

It is preferred that the babble bath assembly has electric power supplying means for supplying dc current to the pump. This power supplying means is adapted to be disposed outside the bathtub.

A silencer tube may be coaxially attached at one of its ends to the nozzle member for reduction of noise due to the jet of water. This silencer tube must have an axial length such that at least the other end of the silencer tube is immersed in the bath water upon the placing of the assembly and upon the filling up of the bathtub with water.

Also, an auxiliary nozzle member, which is connected to the outlet of the pump, may be attached to the bottom housing so that water is jetted out of the auxiliary nozzle member in a generally horizontal direction.

DETAILED DESCRIPTION OF THE PREFERRED EMBODIMENT

Figure 1:
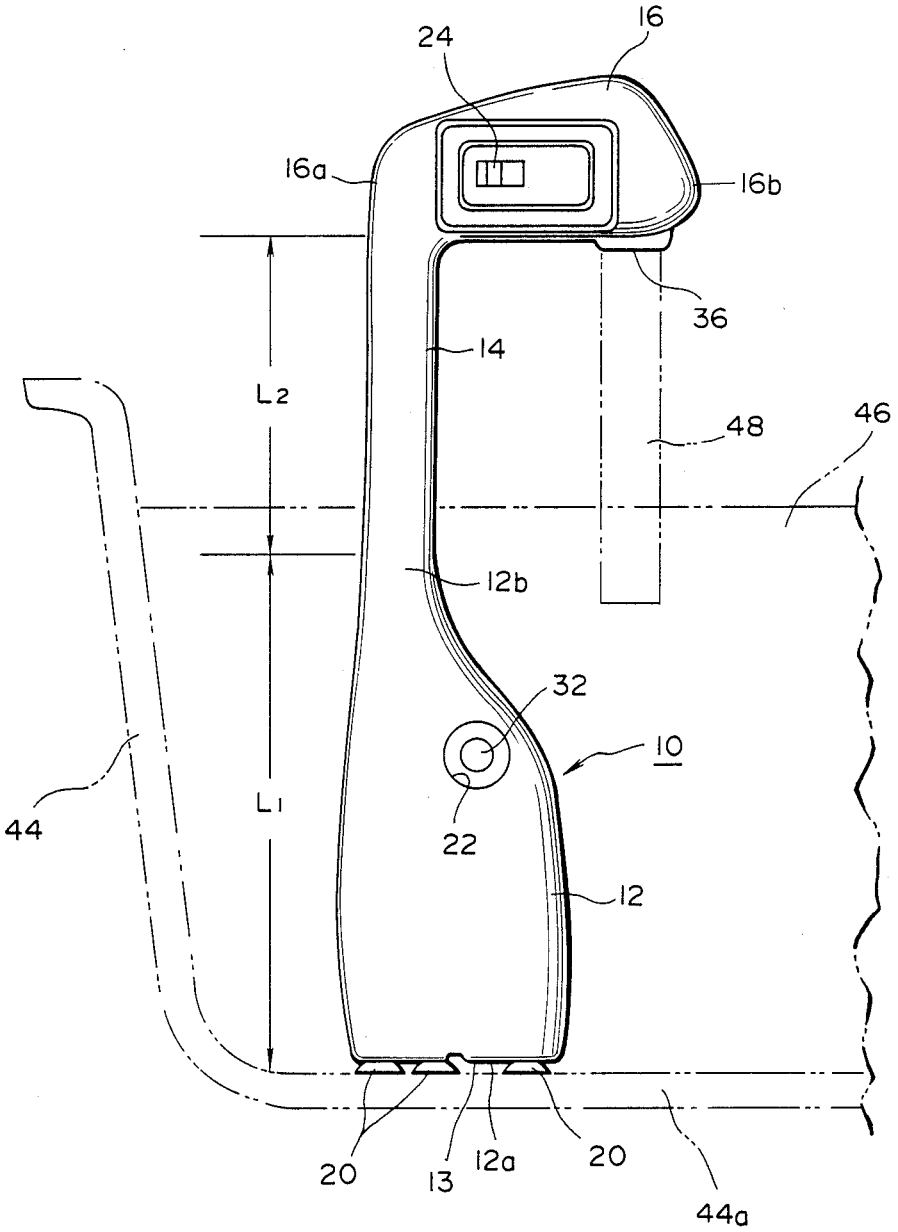
FIG. 1 is a side-elevational view of a portable bubble bath assembly according to the present invention.

Referring now to the drawings, wherein like reference characters designate corresponding parts throughout several views, and descriptions of the corresponding parts are omitted once given.

Figure 2:
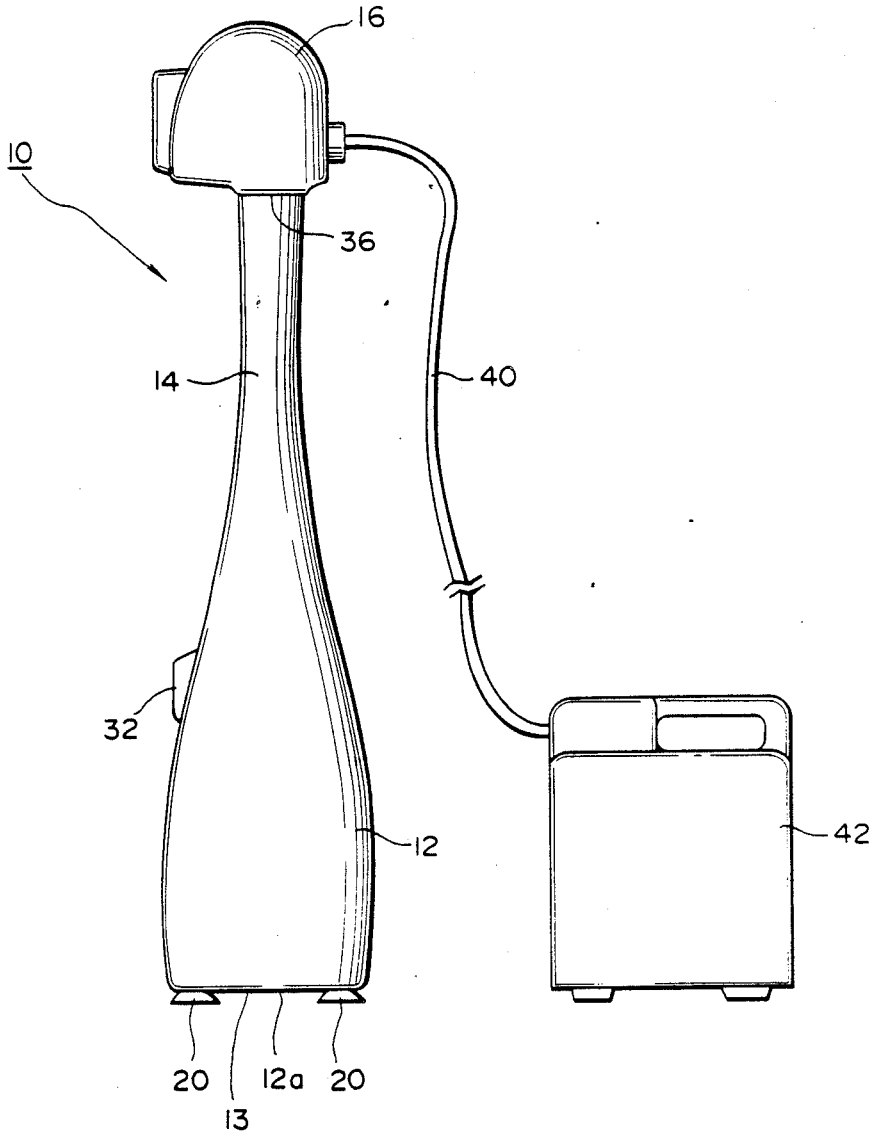
FIG. 2 is a front view of the bubble bath assembly in FIG. 1.
Figure 4:
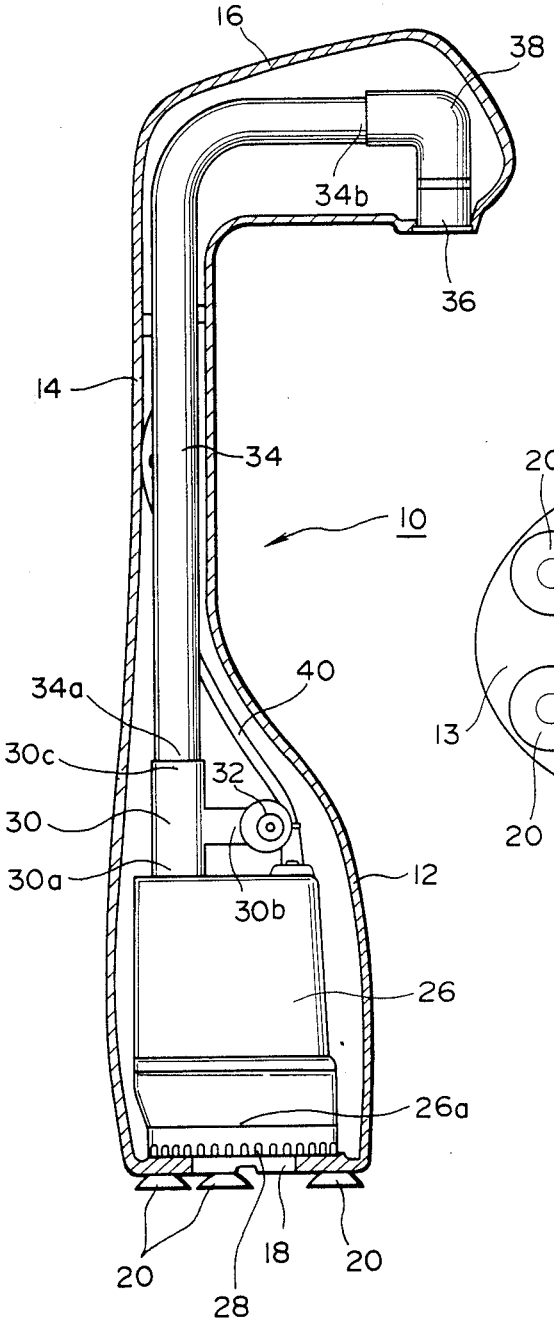
FIG. 4 is an axial-sectional view of the bubble bath assembly in FIG. 1.
Figure 3:
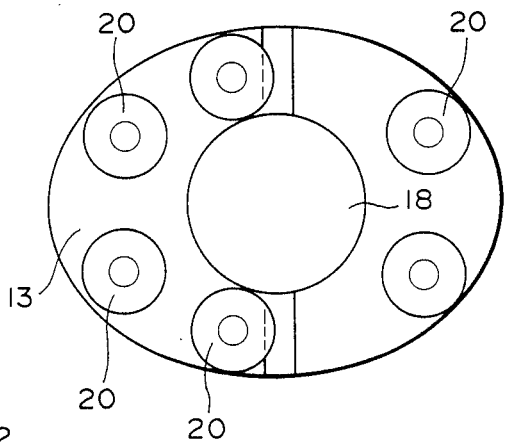
FIG. 3 is a bottom view of the bubble bath assembly in FIG. 1.

In FIGS. 1 to 4, reference numeral 10 designates a portable bubble bath assembly embodying the principle of the present invention. The casing of this assembly is constituted of a series of three housing, that is, a bottle-like bottom housing 12, an elongated neck housing 14 and a fist-like head housing 16. The bottom housing 12 has a lower end 12*a* having a flat end surface 13 and an upper end 12*b* joined to the neck housing 14. The upper end portion of the bottom housing 12 tapers toward its upper end 12*b* so that the upper end 12*b* has a smaller diameter than that of main portion of the bottom housing 12. As shown in FIGS. 3 and 4, a suction opening 18 is formed in the lower end surface 13 of the bottom housing 12, and a plurality of suction cups 20 are attached on that portion of the lower end surface 13 surrounding the suction opening 18. On the side surface of the bottom housing, as shown in FIG. 1, there is formed an aperture 22 in which an auxiliary nozzle hereinafter described is fitted. The neck housing 14 is joined at one of its opposite ends to the upper end 12*b* of the bottom housing 12 so that it extends along an axis extending between the opposite ends 12*a* and 12*b* of the bottom housing 12. The head housing 16 has first and second ends 16*a* and 16*b* and is joined at its first end 16*a* to the other end of the neck housing 14 so that an axis extending between the first and second ends 16*a* and 16*b* is generally perpendicular to the longitudinal axis of the neck housing 14. In the lower face of the head housing 16 near the second end 16*b*, there is formed an aperture (not shown) open toward the bottom housing 12. Into this aperture, a main nozzle hereinafter described is fitted. The head housing 16 also has a off/on switch 24 provided on the side face of the head housing 16. In addition, the sum of the lengths $L_1+L_2$ of the bottom and neck housings 12 and 14 is designed to be substantially larger than the depths of conventional bathtubs.

Figure 5:
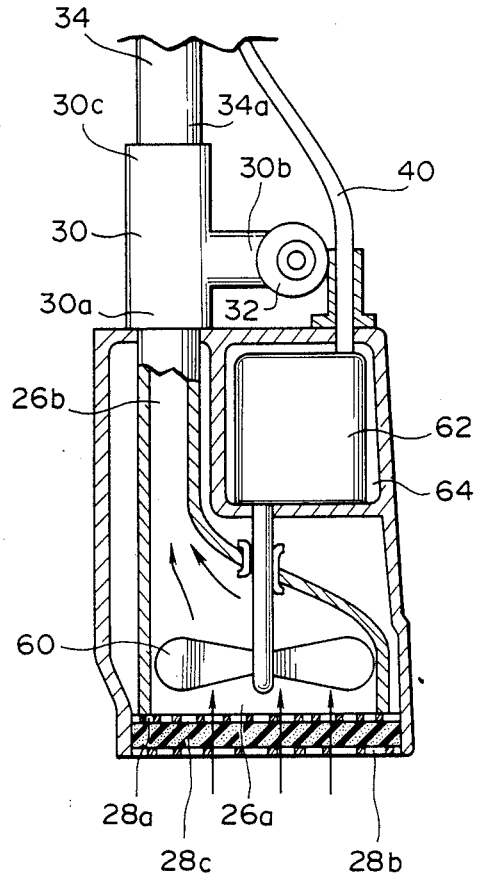
FIG. 5 is an enlarged sectional view of an underwater electric pump in FIG. 4.

As shown in FIG. 4, within the bottom housing 12 is rigidly mounted an underwater electric pump 26. As shown in FIG. 5, this pump 26 has an inlet 26*a* and an outlet 26*b*. The inlet 26*a* of the pump 26 is in communication with the suction opening 18 through the strainer 28 which consists of two sieves 28*a* and 28*b* and a filter medium 28*c* interposed between the sieves. A recumbent T-shaped branch pipe 30 is connected at its lower end 30*a* to the outlet 26*b* of the pump 26. Another end 30*b* of the branch pipe 30 is connected to the auxiliary nozzle 32 which fits in the aperture 22 of the bottom housing 12 so as to project out of the bottom housing 12 through the aperture 22, in a direction generally perpendicular to the neck housing 14. The other end 30*c* of the branch pipe 30 is connected to the lower end 34*a* of an inverted L-shaped connecting pipe 34. This connecting pipe 34, as shown in FIG. 4, extends from the branch pipe 30 toward the head housing 16 through the inside of the neck housing 14, bends and goes into the head housing 16. At the upper end 34*b* of the connecting pipe 34, there is attached the main nozzle 36 via an L-shaped coupling 38. This main nozzle 36 fits in the aperture of the head housing 16 and projects out of the head housing 16 through the aperture. That is to say, the main nozzle 36 is in communication with the outlet 26*b* of the pump 26 through the connecting pipe 34 and also is supported over the pump 26 by both the connecting pipe 34 and the housings 12, 14 and 16.

In FIG. 4, reference numeral 40 denotes an electric cord which connects the pump 26 to an electric power box 42 (see FIG. 2) to be separately installed from the other part of the assembly. This electric cord 40 extends from the pump 26 to the off/on switch 24 through the inside of the neck housing 14 and, as shown in FIG. 2, passes out of the head housing 16 through the side wall of the head housing 16. The electric power box 42 is, for example, a converter for converting a current of AC 100 V into a current of DC 12 V and for supplying the pump 26 with the current of DC 12 V. Otherwise, the power box 42 is a battery charger able to continuously supply a current of DC 12 V for more than 3 hours without the charging of electric power and able to be charged from a electric power source supplying a current of AC 100 V. In addition, reference numeral 60 in FIG. 5 denotes an impeller of the pomp 26 which is drivingly connected to an electric motor 62 disposed in a hermetically sealed chamber 64 in the bottom housing 12.

The operation of the bubble bath assembly thus constructed will now be described. Upon using the bubble bath assembly, the entire body of the assembly except for the power box 42 is brought into a bathroom in which a bathtub is installed, while the electric power box 42 is left outside the bathroom. Then, as shown in FIG. 1, the assembly body is installed in the bathtub 44 filled with water 46. This installment is achieved merely by placing the bottom housing 12 on the bottom wall 44*a* of the bathtub 44 with the neck housing 14 extending upright. Upon the placement of the bottom housing 12, the suction cups 20 are applied to the upper surface of the bottom wall 44*a*, whereby the housing 12 is stably secured to the bottom wall 44*a* of the bathtub 44. In this state, the bottom housing 12 is disposed in the bath water 46 with its lower end surface 13 facing the bottom wall 44*a* of the bathtub 44, and the head housing 16 is supported over the bath water 46 by the neck housing 14.

When the switch 24 is turned on, the pump 26 is actuated. Then, the water 46 in the bathtub 44 is drawn into the pump 26 through the suction opening 18. When the water passes through the suction opening 18, the assembly body is urged by suction toward the bottom wall 44*a* of the bathtub 44 so that the body is held in its position more stably. Also by suction, the suction cups 20 are pressed against the bottom wall 44*a* of the bathtub 44, whereby the bottom housing 12 is secured to the bottom wall 44*a* more stably. The water drawn into the pump 26 is, then, pressurized by the pump 26 and is sent to the main and auxiliary nozzles 32 and 36. The water sent to the auxiliary nozzle 32 is, then, discharged horizontally in a jet from the auxiliary nozzle 32 into the bath water 46. This jet of water generates a swirl in the bathtub 44 and massages a human body in the bath water when it impinges against the human body. On the other hand, the water sent to the main nozzle 36 is discharged in a jet from the nozzles 36 against the surface of the bath water 46. When the jet of water impinges on the surface of the bath water 46, it introduces oxygen in the atmosphere into the bath water 46. This results in the formation of a layer of minute bubbles covering the whole surface of the bath water 46 as well as the generation of a multiplicity of minute bubbles suspended throughout the water 46. When these innumerable bubbles in the water 46 contact the human body immersed in the bath water 46, they break instantly, and generate ultrasonic waves of about 60,000 to 80,000 Hz throughout the bathtub 44. These ultrasonic waves enhance the heat transfer rate between the bath water 46 and the human body, massage the human body and promote the removal of dirt and oils from the skin of the human body, which help in the prevention of skin diseases and muscular pains which can afflict the human body.

In addition, when it is not necessary to keep the aforementioned assembly in the bathtub, the assembly can easily be removed from the bathtub 44 merely by causing the assembly body to be inclined so that the suction cups 20 release the bottom wall 44*a* of the bathtub 44. Also, when the impact of the jetted water is required on a specific part of the human body, by transferring the assembly body within the bathtub 44, the nozzles 32 and 36 can easily be moved to the exact position where the nozzles can affect the specific part.

Figure 6:
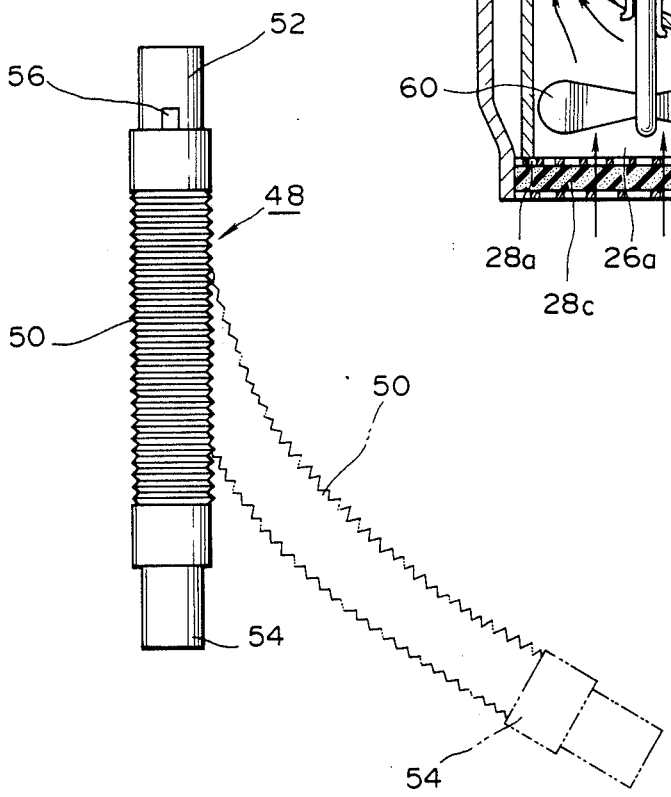
FIG. 6 is an enlarged front view of a silencer tube applicable to the bubble bath assembly in FIG. 1.

FIG. 6 illustrates a silencer tube 48 applicable to the bubble bath assembly. This silencer tube 48 has a bellowslike portion 50 between its upper and lower end portions 52 and 54. The bellowslike portion 50 of this silencer tube 48 is made of a pliant material such as a flexible plastic, and thus, as shown by the phantom line, the tube 48 is expandable, contractible and flexible. The upper end portion 52 of the tube 48 has a thread (not shown) formed on its outer face, and the main nozzle 36 has a thread formed on its inner face, whereby, as shown by the phantom line in FIG. 1, the tube 48 is capable of being coaxially and detachably attached at its upper end to the main nozzle 36. A pair of air intake holes 56 are formed in the upper end portion 52 of the tube 48 so that the external air is taken into the tube 48 through the holes 56. This silencer tube 48 has a length such that, upon its attachment to the main nozzle 36, at the very least, even when the tube 48 is contracted to a minimum length, the lower end of the tube 48 is immersed in the bath water 46. Accordingly, by attaching the tube 48 to the main nozzle 36, the tube 48 serves as a silencer for the reduction of noise that is due to the collision between the bath water 46 and the jet of water discharged from the nozzle 36. Also, by attaching the tube 48, it is possible to change the direction of the flow of the bubble-containing water in the bathtub 44.

In addition, the above-described bubble bath assembly works more effectively, if it is used together with the additive consisting of components including 60% of polyethylene glycol, 28% of sodium hydrogencarbonate, 11.5% of sodium sulfate anhydride, 0.5% of coloring matter and a very small amount of perfume. When a suitable amount of this additive is put into the bubble bath utilizing the bubble bath assembly, the properties of the additive and the bubbles including oxygen influence upon each other so that there is accelerated the formation of the layer of the bubbles over the bath water.

It is understood that although a preferred embodiment of the present invention has been shown and described, various modifications thereof will be apparent to those skilled in the art, and, accordingly, the scope of the present invention should be defined only by the appended claims and equivalents thereof.

What is claimed is:

1. In a bubble bath assembly for use on the bottom wall of a bathtub and for creating a bubbling effect in the water in the bathtub, the bubble bath assembly including: pump means for drawing water thereinto from the bathtub and for discharging water under pressure into the bathtub, the pump means having an inlet and an outlet; a nozzle member connected to the outlet of the pump means for discharging water in a jet therefrom; and means for retaining the nozzle member over the water in the bathtub upon the installment of the assembly in the bathtub so that the jet of water is directed against the surface of the bath water when the pump means is operated, the improvement wherein the pump means comprises an underwater electric pump, and wherein the retaining means comprises: means for stably setting the underwater electric pump on the bottom wall of the bathtub; and support means, interposed between the pump and the nozzle member, for supporting the nozzle member over the pump, said setting means comprising a bottom housing in which said electric pump is enclosed and rigidly mounted, the bottom housing having a lower end surface and being adapted to be disposed within the bathtub, said setting means further comprising one or more suction cup members, attached to and projecting from the lower end surface of the bottom housing, for releasably securing the bottom housing to the bottom wall of the bathtub, said bottom housing including means for urging the bottom housing toward the bottom wall of the bathtub, the urging means comprising a suction opening formed in the lower end surface of the bottom housing, the suction opening in fluid communication with the inlet of the electric pump, said one or more suction cup members being arranged at that portion of the lower end surface around said suction opening, an auxiliary nozzle member connected to the outlet of the pump, the auxiliary nozzle member attached to the bottom housing so that water is jetted out of the auxiliary nozzle member in a generally horizontal direction.

2. A bubble bath assembly according to claim 1, wherein the support means comprises a connecting pipe having opposite ends, the connecting pipe being attached at one end thereof to the nozzle member and at the other end thereof to the pump so that the nozzle member is in fluid communication with the outlet of the pump.

3. A bubble bath assembly according to claim 2, further comprising electric power supplying means for supplying dc current to the pump, the power supplying means being adapted to be disposed outside the bathtub.

4. A bubble bath assembly according to claim 3, further comprising a silencer tube coaxially attached at one end thereof to the nozzle member for reduction of noise due to the jet of water, the silencer tube having an axial length such that at least the other end of the silencer tube is immersed in the bath water upon the placing of the assembly and upon the filling up of the bathtub with water.

* * * * *